United States Patent [19]

Dubuit

[11] Patent Number: 4,592,276

[45] Date of Patent: Jun. 3, 1986

[54] PRINTING MACHINE WITH CURING SYSTEM

[76] Inventor: Jean Louis M. Dubuit, 63 Rue Du Chemin vert, Paris, France, 75011

[21] Appl. No.: 767,806

[22] Filed: Aug. 21, 1985

[51] Int. Cl.[4] ..... B41F 17/22

[52] U.S. Cl. ..... 101/38 A

[58] Field of Search ..... 101/38 R, 38 A, 39, 101/40, 35

[56] References Cited

U.S. PATENT DOCUMENTS

| | | | |
|---|---|---|---|
| 3,933,091 | 1/1976 | von Saspe | 101/40 |
| 4,035,214 | 7/1977 | Shuppert et al. | 101/40 X |
| 4,411,191 | 10/1983 | Combeau | 101/38 A |
| 4,479,429 | 10/1984 | Haryu | 101/38 A |

*Primary Examiner*—E. H. Eickholt

*Attorney, Agent, or Firm*—McDougall, Hersh & Scott

[57] ABSTRACT

A printing machine including a conveyor equipped with spaced-apart carriers for moving articles to a printing station and then to a discharge station, and an intermittently operating drive for the conveyor whereby the carriers are stopped at the printing station. An ultraviolet reactive ink is used during printing with an ultraviolet curing station. The curing station comprises rotatable pick-up means for a printed article whereby the article is adapted to be rotated during exposure at the curing station. An article drive is provided for rotating the pick-up means about its axis, and the article drive has an axis of rotation which is offset relative to the axis of the pick-up means so that an eccentric drive is imparted to the pick-up means. The article drive is connected to the intermittently operated drive whereby the driving action imparted to said pick-up means is simultaneously influenced by said intermittently operated drive and by said eccentric drive.

The curing station also includes a shutter for controlling exposure of the article to ultraviolet light. The shutter includes a pair of plates, a pivotable support for the plates, and a drive adapted to move the plates into blocking position between the ultraviolet light source and the article position at the curing station, and to move the plates out of blocking position, the shutter includes reflectors attached to the plates for reflecting ultra-violet rays and to concentrate the rays on the surface of an article at the curing station.

12 Claims, 7 Drawing Figures

PRINTING MACHINE WITH CURING SYSTEM

BACKGROUND OF THE DISCLOSURE

This invention relates to printing machines and more particularly to screen printing machines which include ultraviolet radiation means for curing of printed subject matter. In a typical application, the printing machine may be employed for labeling plastic containers, and the ultraviolet radiation means is utilized for curing of the subject matter of the label.

U.S. Pat. No. 4,411,191 provides a disclosure discussing printing machines of the general type involved. Such machines include conveyor means having spaced-apart article carriers for accommodating plastic containers or other articles to be printed in the machine. A plurality of work stations may be located along the conveyor including a flame treatment station, a printing station, and a curing station where polymer-based printing materials or the like are employed. In the case of printing operations utilizing solvent based printing materials, a drying station may be associated with the machine or conveyor means may be employed for delivering the containers to some other location for drying.

In the operation of a printing machine of the type described in the aforementioned patent, the drive means for the conveyor provide for intermittent advance of the article carriers to the respective stations. At these stations, the articles are adapted to be picked off the carriers by a mandrel transfer unit so that desired operations, for example printing, can be conducted at the respective stations.

The mandrel transfer units are controlled synchronously with the advance of the conveyor. The transfer units may be controlled by individual piston and cylinder units associated with each transfer unit or by a centrally controlled mechanism.

The aforementioned patent particularly describes an economic centrally controlled system for the transfer units. This mechanism generally involves the use of a cam which synchronously controls the operation of the mandrel transfer units with the advance of the conveyor. A single cam can be used for two or more of the work stations, and a cam follower operates with the single cam and is carried on an arm fixed for rotation with a central control shaft common to the respective stations.

An actuating lever controlling each of the mandrel transfer units is mounted for movement with this central control shaft. The lever for one of the control stations preferably comprises the arm carrying the cam follower. In this fashion, a single lever serves as the drive arm for the central control shaft and also as the actuating lever for one of the mandrel transfer units.

SUMMARY OF THE INVENTION

This invention relates to a machanically controlled printing machine of the type described wherein a conveyor is equipped with a plurality of spaced-apart article carriers for moving articles to be printed between various stations including a printing station and a discharge station. The invention particularly contemplates the provision of an ultraviolet curing station between the printing and discharge station so that articles passing through the system are discharged with labels or the like completely cured.

One particular improvement of the invention relates to the mandrel transfer unit used at the curing station as a pick up means for a printed article. This pick-up means is designed for rotation about its axis whereby the printed article is adapted to be completely exposed to ultraviolet radiation during curing. The drive means for the pick-up means, on the other hand, has an axis of rotation which is offset relative to the axis of rotation of the pick-up means whereby an eccentric drive is imparted to the pick-up means.

The article drive means is operatively connected to the intermittently operating drive means for the conveyor in the system. In the ordinary operation of printing machines of the type related to this invention, a Geneva wheel is employed for imparting the driving action to the conveyor and, accordingly, the speed of the drive is not consistent. The driving action imparted to the pick-up means is simultaneously influenced by the intermittently operated conveyor drive means, and by the eccentric drive means. Due to the fact that the offsetting of the axes of the pick-up means and article drive means can be selected to meet particular conditions, the result of this simultaneous influence is that the article can be rotated at a substantially constant speed during exposure to the ultraviolet. In this fashion, uniform curing of the printing material is achieved.

The system of the invention also contemplates improvements in the construction of the ultraviolet curing station. In particular, shutter means are provided for controlling exposure of the printed article to the ultraviolet so that the efficiency of the curing operation is enhanced. This is accomplished by the use of pivotally mounted plates and associated drive means for moving the shutter plates into and out of blocking position between the ultraviolet source and the article in the curing station. Reflectors are attached to these plates in a fashion such such that the ultraviolet rays concentrate on the article at the curing station.

These plates and associated reflectors are preferably hinged members having adjusting means for controlling the respective positions of the reflectors on a given plate. By making suitable adjustments, the most efficient concentration of the ultraviolet rays can be achieved.

DESCRIPTION OF THE PREFERRED EMBODIMENTS

Figure 1:
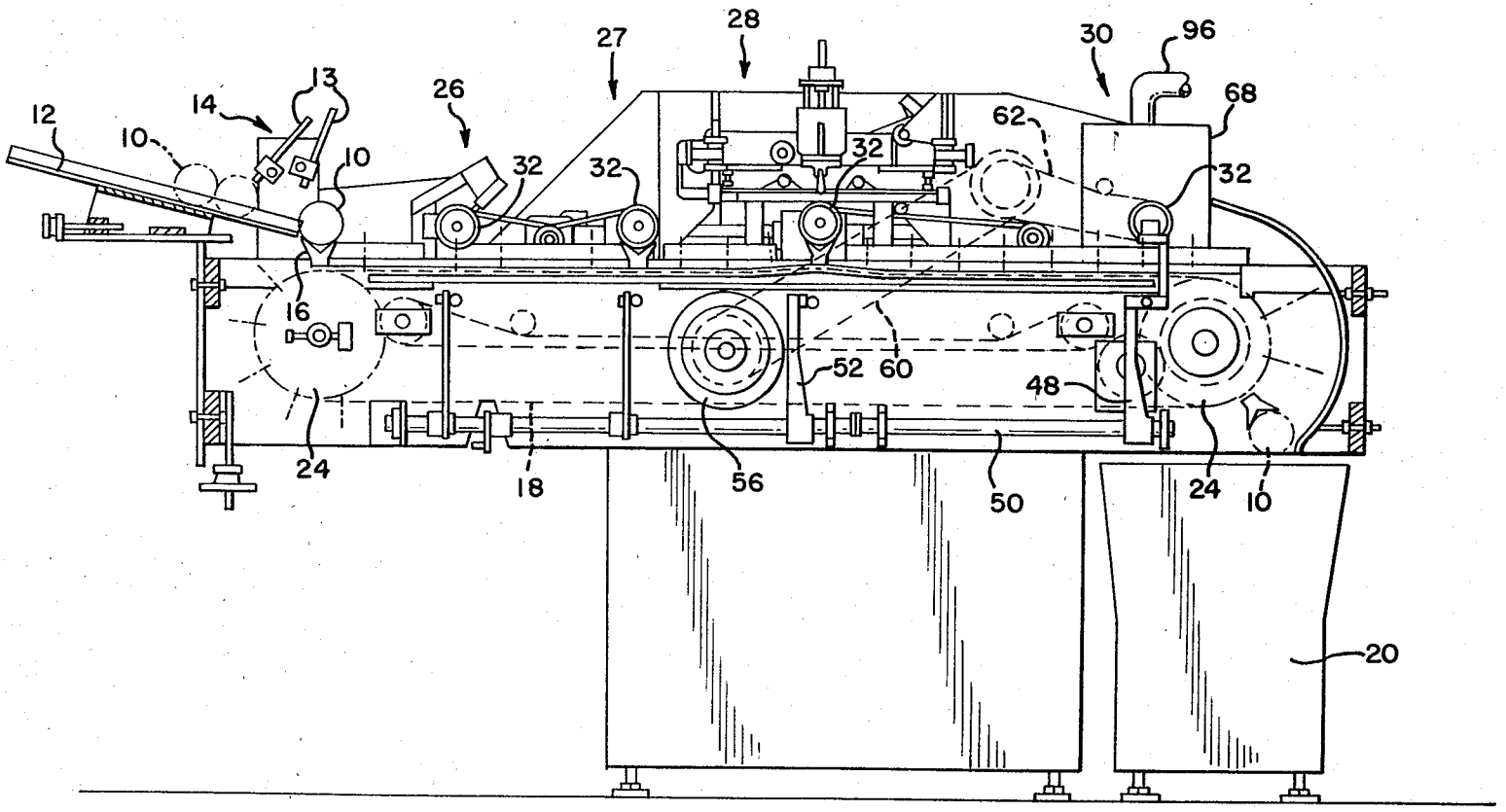
FIG. 1 comprises a side elevational view of a printing machine characterized by the features of this invention.

As shown in FIG. 1, the invention is described with reference to the printing and curing of articles 10 which, in the case illustrated, may comprise plastic bottles. The bottles are fed into the system by means of a tray 12 located for engagement by elements 13 at feed station 14. Reference is made to the aforementioned patent for a more complete description of this station.

Bottles delivered from tray 12 into the system are situated on individual carriers 16 associated with delivery conveyor 18. These article carriers are located on the conveyor at regular intervals, and they serve to move each bottle 10 along the length of the machine until the bottles are eventually discharged into a hopper 20. In the illustrated arrangement, the bottles may be simply allowed to fall by gravity into the hopper; however, the invention also contemplates the use of separate conveyor means for moving the bottles away from the machine.

Figure 4:
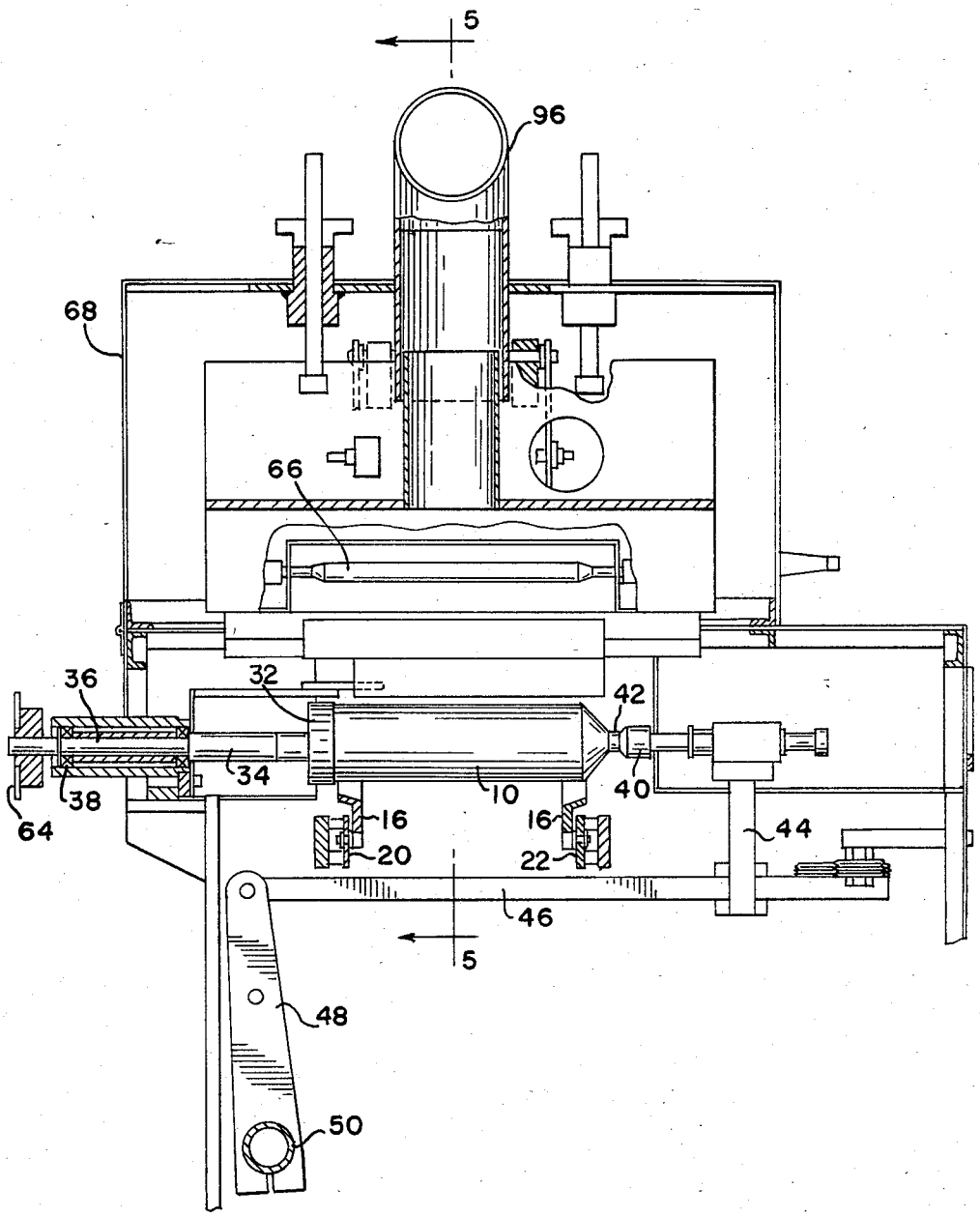
FIG. 4 is a vertical, sectional view taken at the ultraviolet curing station of the system.

The conveyor 18 may consist of two parallel endless chains 22 as illustrated in FIG. 4. These chains are driven over sprockets 24 at opposite ends of the machine with one of the sprockets comprising a drive sprocket connected to conveyor drive means. In accordance with typical screen printing machines, the conveyor drive may comprise a Geneva wheel rotated by a motor associated with a speed reducing gear.

The article carriers 16 comprise opposed angle members for supporting each bottle on its side as the bottle progresses through the machine. In a typical operation, the bottle will be exposed to separate work stations including, for example, a flame treatment station 26, a prepositioning station 27, a printing station 28, and a curing station 30. With respect to the flame treating and printing stations, reference is again made to the aforementioned issued patent.

Also as described in the aforementioned patent, the respective stations are provided with pick-up means for the bottles. These pick-up means, as illustrated in FIG. 4, include a rotatable cup member 32 supported on a shaft 34 having a portion 36 supported by bearings 38. This cup member is fixed in position at the respective stations along with a mandrel 40 positioned on the opposite side of the conveyor. As shown in FIG. 4, this permits engagement of the mandrel 40 with the neck 42 of bottle 10 while the base of the bottle is received by the cup member 32.

The mandrel 40 is mounted on support 44 which is tied to bar 46. The bar 46 is, in turn, connected to lever 48 supported on control shaft 50.

Figure 2:
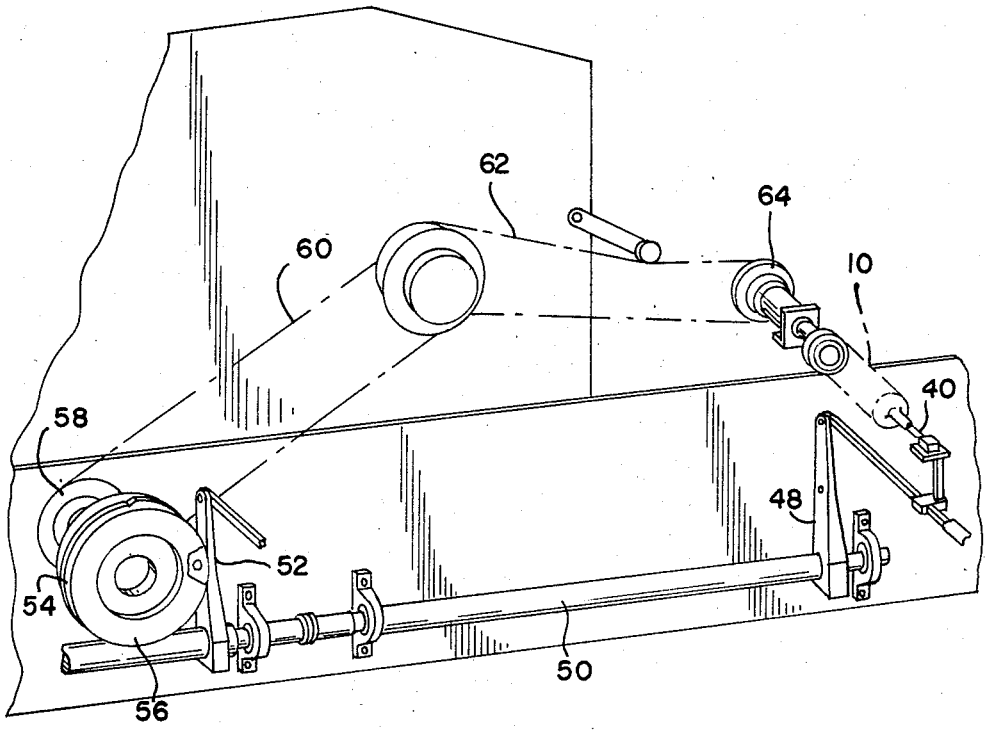
FIG. 2 is a fragmentary perspective view of drive means utilized for controlling rotation of an article at an ultraviolet curing station.

As shown in FIG. 2, the shaft 50 carries an additional lever 52 which supports a cam follower engageable with grooved cam track 54 defined by cam 56. Variations in the position of the groove relative to the cam surface result in pivoting movements of lever 52 as the cam 56 rotates. The pivoting movements of the lever 52 are translated to pivoting movement of lever 48 which, in turn, causes movement of the mandrel 40 toward and away from the neck of a bottle 10. As explained in the aforementioned patent, when the mandrel 40 advances toward the neck of the bottle, a slight lifting action of the bottle occurs so that the bottle becomes free to rotate without engagement with the underlying carrier 16.

Driving of the cam 56 is accomplished by the Geneva wheel associated with the system. Accordingly, the cam track 54 is designed so that the operation of the mandrels 40 is timed in accordance with the arrival of the bottles at the respective stations.

A sprocket 58 is also connected to the shaft supporting cam 56. This sprocket will, therefore, also rotate in response to the drive of the Geneva wheel, and drive chains 60 and 62 are employed for imparting this drive to sprocket 64 asssociated with cup member 32. (FIGS. 2 and 4). Accordingly, operation of the Geneva wheel after engagement of a mandrel 40 with a bottle will result in rotation of that bottle in response to rotation of cup 32.

Since the drive speed imparted by the Geneva wheel is not constant, the peripheral speed of the bottle 10 would be non-uniform if the axis of sprocket 64 coincided with the axis of bottle 10. In accordance with this invention, the axis of bottle 10 is offset relative to the axis of the cup 32 supporting the bottle so that the non-uniform speed imparted by the Geneva can be compensated by the eccentric drive imparted by sprocket 64. The result comprises a substantially uniform speed for the surface of the bottle 10.

Figure 3:
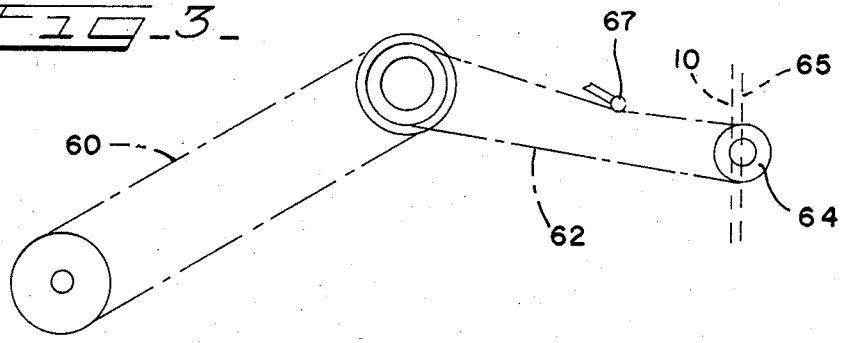
FIG. 3 is a schematic view illustrating the eccentric nature of the drive means.
Figure 7:
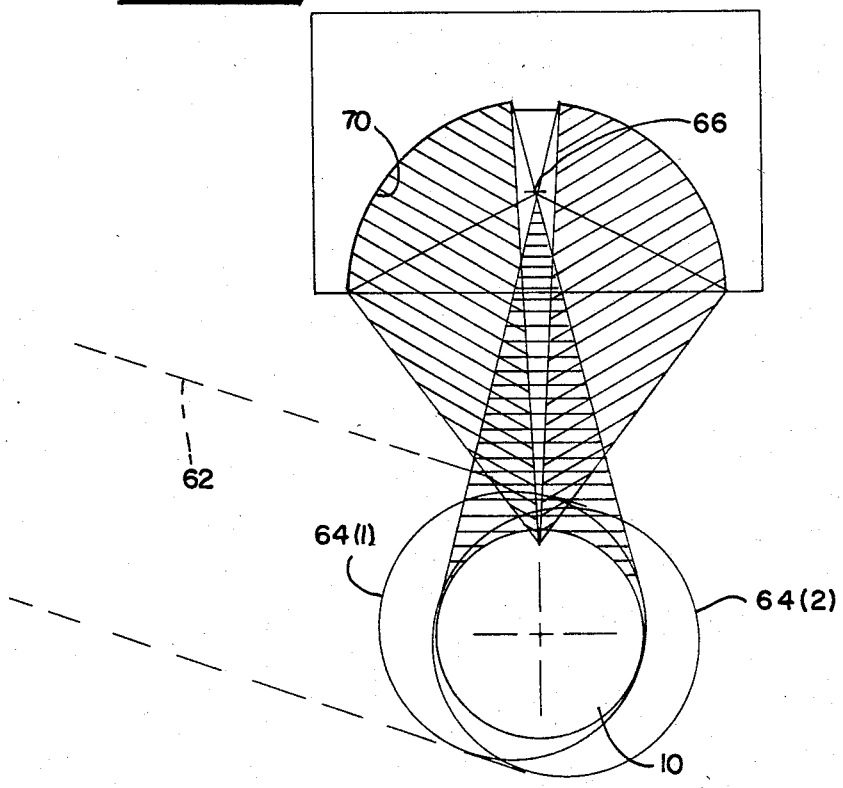

FIGS. 3 and 7 schematically illustrate the relationship of a bottle 10 and sprocket 64. In FIG. 3, the line 11 is intended to intersect the axis of a bottle 10 while the line 65 extends through the axis of sprocket 64. FIG. 7 illustrates the relative positions of these axes in a different fashion. The axis of the bottle 10 is stationary while the axis of the sprocket 64 shifts between the positions 64(1) and 64(2). In view of this shifting movement, a conventional spring-loaded take-up means 67 for slack in the chain 64 is provided.

It will be appreciated that the offset between the respective axes can be varied to accommodate the particular conditions encountered. Thus, the diameter of a bottle, the changes in speed of the Geneva drive and other factors will influence the set-up in the system required for achieving the desired peripheral speed of the printed bottle. Where other types of articles are involved, additional factors might be considered in achieving the practical advantages of the invention, for example, where the article does not have a circular cross-section. It may also be desirable, in some instances, to use the concept of the invention for achieving non-uniformity in surface speed.

Figure 5:
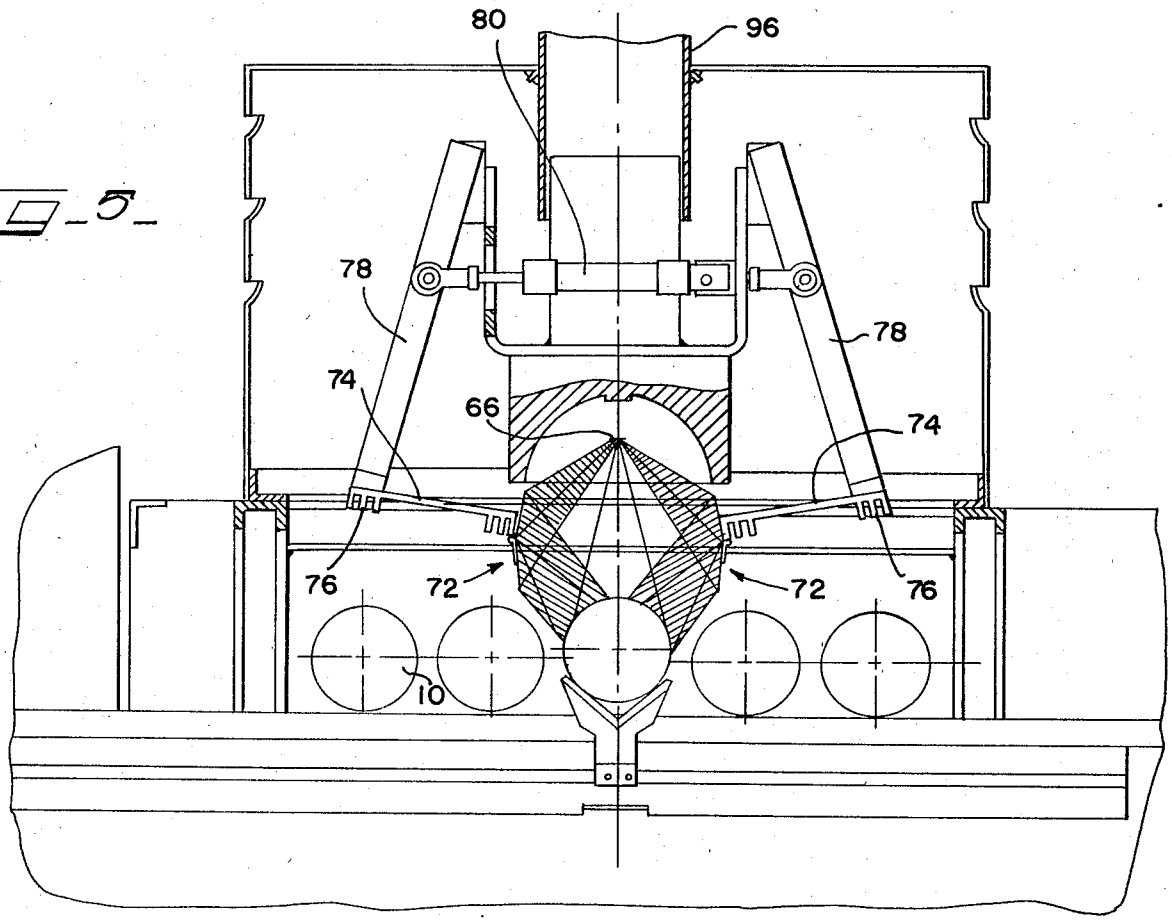
FIG. 5 is a vertical sectional view taken about the line 5—5 of FIG. 4 illustrating the shutter mechanism employed at the ultraviolet curing station.

The drive arrangement of the invention shown in FIG. 2 is of particular advantage when associated with a ultraviolet curing system. As shown in FIGS. 4, 5 and 7, an ultraviolet light source 66 is positioned in a housing 68 to permit exposure of the bottle 10 to the ultraviolet rays. The source is positioned within a stationary reflector means 70 so that both direct and indirect rays can be concentrated on the bottle 10. Since the bottle has only a portion of its surface positioned for exposure to the rays, it is necessary to rotate the bottle to insure exposure over the entire surface of the bottle. It will be appreciated that if the bottle 10 is rotated at significantly different speed during this exposure, then some portions may be over-exposed, and some portions under-exposed.

By utilizing the eccentric drive arrangement of the invention, the speed differences resulting from the Geneva wheel drive can be overcome. In particular, the eccentric can be arranged so that slow movement imparted by the Geneva drive will be compensated for by increased peripheral speed imparted by the eccentric. As the speed imparted by the Geneva tends to increase, the position of the eccentric will be such that its influence on the peripheral speed of the bottle will be diminished. The compensating factors do not necessarily result in exact constant peripheral speed for the bottle surfaces but the speed can be controlled sufficiently so that unsuitable differences in exposure time will not occur.

In a given system, it may be desirable to increase exposure time by rotating a bottle more than one time in the curing operation. This can be accomplished by varying the ratio between the sprockets 58 and 64; however, the ratio should be a whole number. (1:1 to 2:1, etc.) With this arrangement, the starting point for the drive movement will always be the same and the respective influences imparted by the Geneva and eccentric will be the same.

FIG. 7 also serves to illustrate the manner in which ultraviolet rays are directed to the surface of bottle 10 when the ultraviolet source 66 is positioned opposite reflector surfaces 70. As shown, the bottle surface is exposed to direct radiation from the light source and to indirect radiation from the reflector surfaces.

Figure 6:
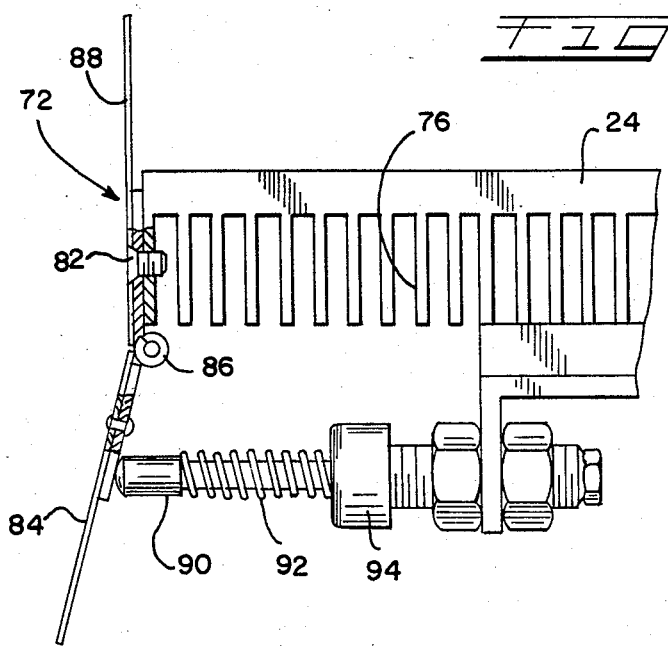
FIG. 6 is an enlarged fragmentary, detailed view of the shutter mechanism; and, FIG. 7 is a schematic illustration of a radiation pattern which may be achieved during curing, and also illustrating the eccentric drive.

FIGS. 4–6 illustrate an arrangement which adds additional reflector means to achieve more efficient exposure of a bottle 10 to the ultraviolet rays. In this arrangement, reflectors 72 are mounted on supports 74 which include ribs 76 for dissipating heat generated during use of the equipment. Each of the supports 74 is mounted on a pivoting arm 78, and these arms are, in turn, controlled by pneumatic cylinders 80. In each instance, the cylinders operate pistons which, when extended from the cylinders, pivot the arms 78 outwardly and which, when retracted, pull the arms 78 inwardly toward each other.

The supports 74 comprise opaque plates to that when the arms 78 are pulled inwardly, the supports serve as shutters blocking the exposure of the curing location to the ultraviolet rays. This provides a most expedient means for operating the system since with this arrangement, it is not necessary to turn the ultraviolet light 66 on and off to achieve curing. Instead, the structure is designed so that when a bottle is moved into position for curing, any suitable switch means may be used to initiate operation of the cylinders 80 thereby opening the shutters. The opening of the shutters can be easily timed in relation to the rotation of a bottle to insure uniform exposure of the bottle surfaces as discussed above.

As indicated, the shutters carry reflectors 72 which are attached to the mounting means 74 by means of fasteners 82. Each of the reflectors includes a lower portion 84 hinged at 86 to the upper portion 88 of the reflectors. The end of a rod 90 is engageable with the back side of each of the hinged poortions 84 and spring 92 coupled with threaded collar 94 permit adjustment in the angle of the portion 84 relative to the portion 88. As shown in FIG. 5, this provides for the exposure of the surface of a bottle 10 to rays from the source 66 in addition to those achieved with the arrangement shown in FIG. 7. Specifically, rays which would normally by-pass the container are reflected onto the surface of the container to provide more efficient use of the rays. The hinged portions 84 of the reflectors can be given fine adjustments in order to achieve the most effective exposure depending on the size and shape the article involved.

Due to the use of spring 92, the rod 90 is adapted to be forced rearwardly relative to collar 94. Accordingly, the respective hinged portions 84 will press against each other when the shutter is closed to eliminate or minimize passage of rays beyond the shutter. The hinged portions will then immediately assume the proper angle when the shutter is opened as the spring 92 forces the rod 90 back to its original position.

In addition to the heat radiating ribs 76 provided on the mounting means 74, the housing 68 at the curing station may include exhaust means 96 so that there will be a minimum of heat build-up caused by the ultraviolet curing means. Other conventional features utilized in ultraviolet light radiating means may be found in the prior art, for example, in U.S. Pat. Nos. 3,934,500 and 4,072,099.

It will be understood that various changes and modifications may be made in accordance with the foregoing specification without departing from the spirit thereof particularly as defined in the following claims.

I claim:

1. In a mechanically controlled printing machine including a conveyor equipped with a plurality of spaced-apart article carriers for moving articles to be printed to a printing station and then to a discharge station, and intermittently operating drive means for the conveyor whereby the respective article carriers are stopped at the printing station to permit conduct of the printing operation, and wherein ultraviolet reactive ink is used during printing with an ultraviolet curing station being provided for curing of the ink, the improvement in said curing station comprising pick-up means for picking up a printed article, said pick-up means being rotatable about its axis whereby the article is adapted to be rotated during exposure at the curing station, article drive means for rotating said pick-up means about its axis, said article drive means being non-uniform, said article drive means being operatively connected to said intermittently operated drive means whereby the driving action imparted to said pick-up means is simultaneously influenced by said intermittently operated drive means and by said non-uniform drive.

2. An apparatus in accordance with claim 1 wherein said intermittently operating drive means includes a control cam, a cam follower associated with said control cam, and means connected to said cam follower for operating said pick-up means.

3. An apparatus in accordance with claim 2 wherein said pick-up means includes a mandrel movable into engagement with one end of an article in response to operation by said cam follower, and a rotatable cup means for engagement with the opposite end of said article, said non-uniform drive being composed of an eccentric drive whereby article drive means have an axis of rotation offset relative to the axis of said pick-up means.

4. An apparatus in accordance with claim 3 wherein said cam follower is connected to a lever mounted on a rotatable shaft, a second lever mounted on the shaft, said second lever being connected to said mandrel.

5. An apparatus in accordance with claim 4 including a third lever mounted on said shaft, pick-up means for an article located at said printing station, said third lever operating said pick-up means at said printing station.

6. An apparatus in accordance with claim 2 including a first sprocket mounted on the axis of said control cam, and a second sprocket drivingly connected to said first sprocket, said second sprocket comprising the article drive means with its axis offset from the axis of the pick-up means.

7. An apparatus in accordance with claim 6 wherein the drive ratio between said first and second sprocket is one or an even multiple of one whereby the angular position of any point of the second sprocket is the same at the end of each complete revolution of the control cam.

8. In a mechanically controlled printing machine including a conveyor equipped with a plurality of spaced-apart article carriers for moving articles to be printed to a printing station and then to a discharge station, and intermittently operating drive means for the conveyor whereby the respective article carriers are stopped at the printing station to permit conduct of the printing operation, and wherein ultraviolet reactive ink is used during printing with an ultraviolet curing station being provided for curing of the ink, the improvement comprising shutter means for controlling exposure of the article to ultraviolet light, said shutter means including a pair of plates, pivotable support means for the plates, and drive means for the plates adapted to move the plates into blocking position between the ultraviolet light source and the article positioned at the curing station, and to move the plates out of blocking position, and including reflectors attached to said plates for reflecting ultra-violet rays to concentrate the rays on the surface of an article at the curing station.

9. An apparatus in accordance with claim 8 including a separate arm for supporting each of said plates, means pivotally supporting each separate arm, and including piston and cylinder means attached to the separate arms to provide said drive means for the plates.

10. An apparatus in accordance with claim 8 wherein said reflector means comprise first and second hinged members positioned on opposite sides of said light, and including means for adjusting the direction of radiation imposed on said articles.

11. An apparatus in accordance with claim 10 wherein said reflector means each include an upper portion connected to a shutter means, and a lower portion hinged to the upper portion, said adjusting means including spring loaded means mounted on the shutter means.

12. An apparatus in accordance with claim 11 wherein moving said plates into blocking position results in engagement of the respective lower reflector portions and in subsequent pivoting of these lower portions in opposition to said spring loaded means, and wherein movement of the plate out of locking position results in return of said lower porions to said angle in response to said spring loaded means.

* * * * *